US007008036B2

(12) United States Patent
Ju et al.

(10) Patent No.: US 7,008,036 B2
(45) Date of Patent: Mar. 7, 2006

(54) EJECTION CONTROLLING DEVICE FOR INKJET PRINTER AND CONTROLLING METHOD THEREOF WITH OPTIMAL DENSITY

(75) Inventors: Young-bok Ju, Seongnam (KR); Dae-hyeok Im, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/653,903

(22) Filed: Sep. 4, 2003

(65) Prior Publication Data

US 2004/0085384 A1 May 6, 2004

(30) Foreign Application Priority Data

Nov. 2, 2002 (KR) ..... 10-2002-0067624

(51) Int. Cl.
*B41J 29/393* (2006.01)

(52) U.S. Cl. ..... 347/19; 347/14

(58) Field of Classification Search ..... 347/9–10, 347/12–14, 19, 56, 61, 63, 65, 67
See application file for complete search history.

(56) References Cited

U.S. PATENT DOCUMENTS 5,049,904 A * 9/1991 Nakamura et al. ..... 347/19
6,312,078 B1 * 11/2001 Wen ..... 347/12

* cited by examiner

*Primary Examiner*—Juanita D. Stephens
(74) *Attorney, Agent, or Firm*—Staas & Halsey LLP

(57) ABSTRACT

An ejection controlling device for an inkjet printer and a controlling method thereof includes determining whether an ink cartridge is installed in the inkjet printer, printing patterns in order by driving an ink ejection heater with an array of predetermined pulses with widths that vary in sequential order in response to the ink cartridge being connected to the inkjet printer, detecting printing densities of the printed patterns; determining the pattern with an optimal density among the printing densities, and storing the width of the pulse corresponding to the pattern with the optimal density as an optimal pulse width.

16 Claims, 4 Drawing Sheets

EJECTION CONTROLLING DEVICE FOR INKJET PRINTER AND CONTROLLING METHOD THEREOF WITH OPTIMAL DENSITY

CROSS-REFERENCE TO RELATED APPLICATIONS

This application claims the benefit of Korean Application No. 2002-67624, filed Nov. 2, 2002, in the Korean Intellectual Property Office, the disclosure of which is incorporated herein by reference.

BACKGROUND OF THE INVENTION

1. Field of the Invention

The present invention relates to an inkjet printer, and, more particularly, to an ejection controlling device for an inkjet printer, and a controlling method thereof, that is capable of adjusting an amount of ejected ink properly.

2. Description of the Related Art

A general inkjet printer drives an ink ejection heater for ejecting ink in an ink cartridge to print onto a printing medium. The inkjet printer comprises a heater driving control unit for controlling a width or waveform of a driving pulse to drive the ink ejection heater according to a temperature of an ink cartridge head.

FIG. 1 is a graph showing a driving pulse of a conventional ink injection heater. P1 represents a pre-heat pulse for pre-heat, P3 represents a main pulse of the heater, and P2 is an interval between P1 and the main pulse P3.

Conventionally, the temperature of the ink cartridge head is measured so that the width of the driving pulse is changed according to the measured temperature, to adjust a possible time for ejection. Namely, when the measured temperature is lower than a predetermined temperature, the pre-heat pulse P1 is added, or the width of the main pulse is lengthened, to increase an amount of energy applied to the heater. Further, when the measured temperature is higher than the predetermined temperature, the pre-heat pulse is removed, or the width of the main pulse is shortened, to decrease the amount of energy applied to the heater, thereby obtaining a uniform ink ejection feature.

With the above conventional method for adjusting the pulse applied to the ink ejection heater according to the temperature of the ink cartridge head, the same pulses are applied to all heads, according to the temperatures of the heads, without distinction as to whether the heads are of a mono cartridge or a color cartridge. However, there are variations according to the heads, and resistances of the ink ejection heater in a predetermined range, which function as important factors in determining the amount of ink ejection energy. These variations prevent a uniform amount of ink ejection, thereby degrading the printing quality.

SUMMARY OF THE INVENTION

An aspect of the invention is to solve at least the above problems and/or disadvantages, and to provide at least the advantages described hereinafter.

Accordingly, one aspect of the present invention is to solve the foregoing and/or other problems by providing a controlling device for an ink ejection heater of an inkjet printer and a method thereof that is capable of removing a variation due to each ink cartridge head by setting an optimal width of a pulse, depending on each head, for supplying uniform ejection energy.

Additional aspects and/or advantages of the invention will be set forth in part in the description which follows and, in part, will be obvious from the description, or may be learned by practice of the invention.

The foregoing and/or other aspects and advantages are realized by providing a method of controlling an inkjet printer comprising determining whether an ink cartridge is installed in the inkjet printer; printing patterns in order by driving an ink ejection heater with an array of predetermined pulses with widths that vary in sequential order in response to the ink cartridge being connected to the inkjet printer; detecting printing densities of the printed patterns; determining the pattern with an optimal density among the printing densities; and storing the width of the pulse corresponding to the pattern with the optimal density as an optimal pulse width.

The determination of the pattern with the optimal density may comprise comparing the printing densities of each of the printed patterns, after the first printed pattern, with that of the respective previous printed pattern; storing the width of the pulse corresponding to the current density in response to the current density being larger, by a predetermined difference, than the previous density; and storing the width of the pulse corresponding to the previous density in response to the current density not being larger, by the predetermined difference, than the previous density.

The widths of the pulses in sequential order may comprise pulses with widths descending by a predetermined width difference from a reference pulse, and pulses with widths ascending by the predetermined width difference from the reference pulse, and the reference pulse may have a mean width of the array of predetermined pulses.

According to another aspect of the invention, a controlling device for an inkjet printer having an ink ejection heater comprises: a cartridge receiving part installing an ink cartridge therein and outputting an install detection signal; a driving part driving the ink ejection heater, in accordance with an external input control signal, to eject ink in the ink cartridge while performing a printing operation; a sensor detecting printing densities of patterns printed on printing media by the printing operation driven by the driving part; a controlling part controlling the driving part so that pulses with widths that vary in sequential order by a predetermined width difference are applied to the ink ejection heater to print patterns corresponding to the widths of the pulses, and determining the width of the pulse corresponding to the pattern with an optimal density by comparing the printing densities outputted from the sensor; and a memory storing the width of the pulse corresponding to the pattern with the optimal density determined by the controlling part.

The widths of the pulses in sequential order may comprise pulses with widths descending by a predetermined width difference from a reference pulse, and pulses with widths ascending by the predetermined width difference from the reference pulse.

The controlling part may compare the densities of the patterns in ascending order to determine, as an optimal pulse width, the width of the pulse corresponding to the pattern which has the highest density that is larger, by a predetermined difference, than the density of the previous pattern.

The controlling part may control the driving part to perform the printing operation according to the width of the pulse stored in the memory upon inputting a printing command.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
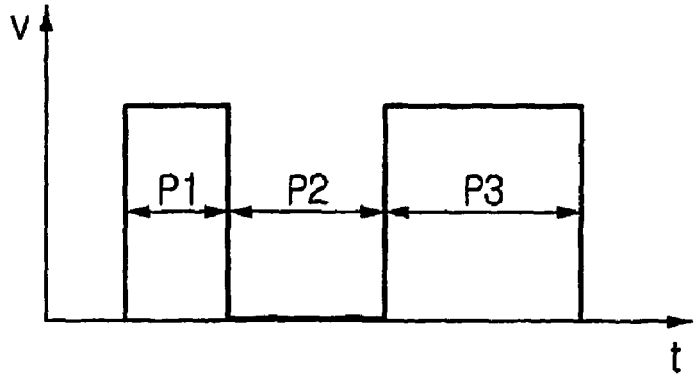
FIG. 1 (PRIOR ART)
FIG. 1 is a graph showing a driving pulse of a conventional ink ejection heater.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
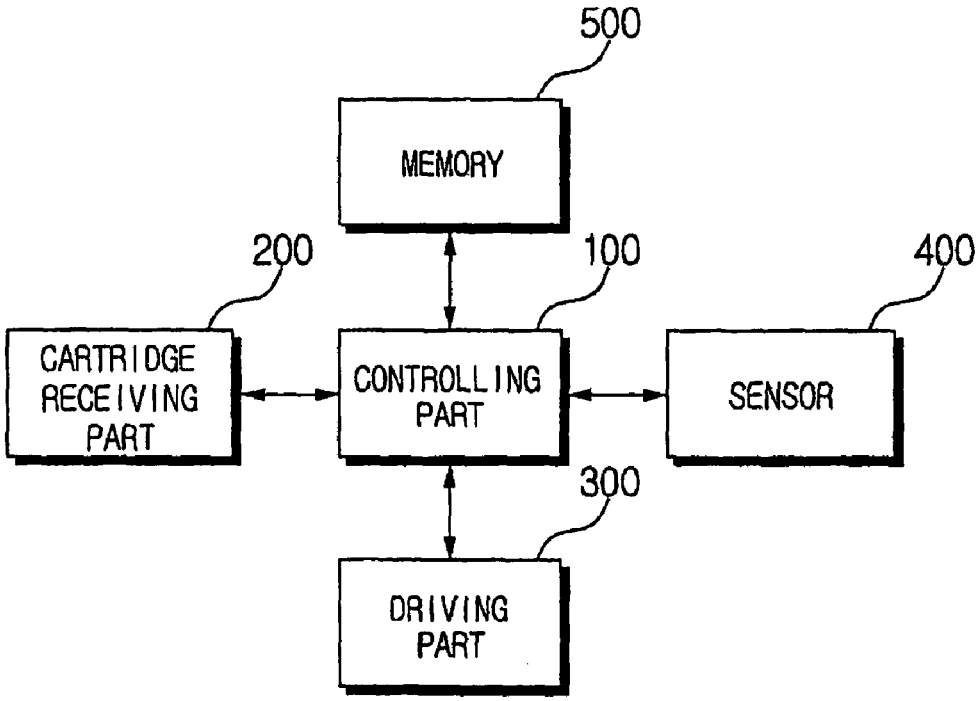
FIG. 2 is a block diagram of a controlling device for an ink ejection heater according to an embodiment of the invention.

FIG. 2 is a block diagram of a controlling device for an inkjet printer according to an embodiment of the invention. As shown in FIG. 2, the controlling device comprises a cartridge receiving part 200 receiving an ink cartridge, a driving part 300 driving an ink ejection heater to perform a printing operation, a sensor 400 sensing printing densities of printed patterns, a controlling part 100 setting widths of pulses to be inputted to the ink ejection heater, and controlling the controlling device for the inkjet printer overall, and a memory 500 for storing an optimal width of a pulse determined by the controlling part 100.

The cartridge receiving part 200 installs the ink cartridge therein, and outputs a cartridge install detection signal to the controlling part 100 when the ink cartridge is installed. The driving part 300 applies pulses to the ink ejection heater in response to a control signal from the controlling part 100 to perform the printing operation by ejecting ink onto a printing medium such as a paper.

The sensor 400 detects a printing density of a pattern printed on the printing medium to output the detected density to the controlling part 100. The sensor 400 may be disposed under the cartridge. The memory stores the width of the pulse corresponding to the optimal density determined by the controlling part 100 to allow the printing operation according to the stored width of the pulse.

Upon receiving the cartridge install detection signal from the cartridge receiving part 200, the controlling part 100 transmits the control signal to the driving part 300 to output pulses with predetermined widths in sequential order to perform printing of the patterns, and determines the optimal width of the pulse corresponding to the optimal pattern by comparing the densities of the printed patterns.

The optimal width of the pulse determined by the controlling part 100 is stored in the memory 500, and is set as a reference width of the pulse to be inputted to the ink ejection heater during printing operations until a new cartridge is installed.

Figure 3:
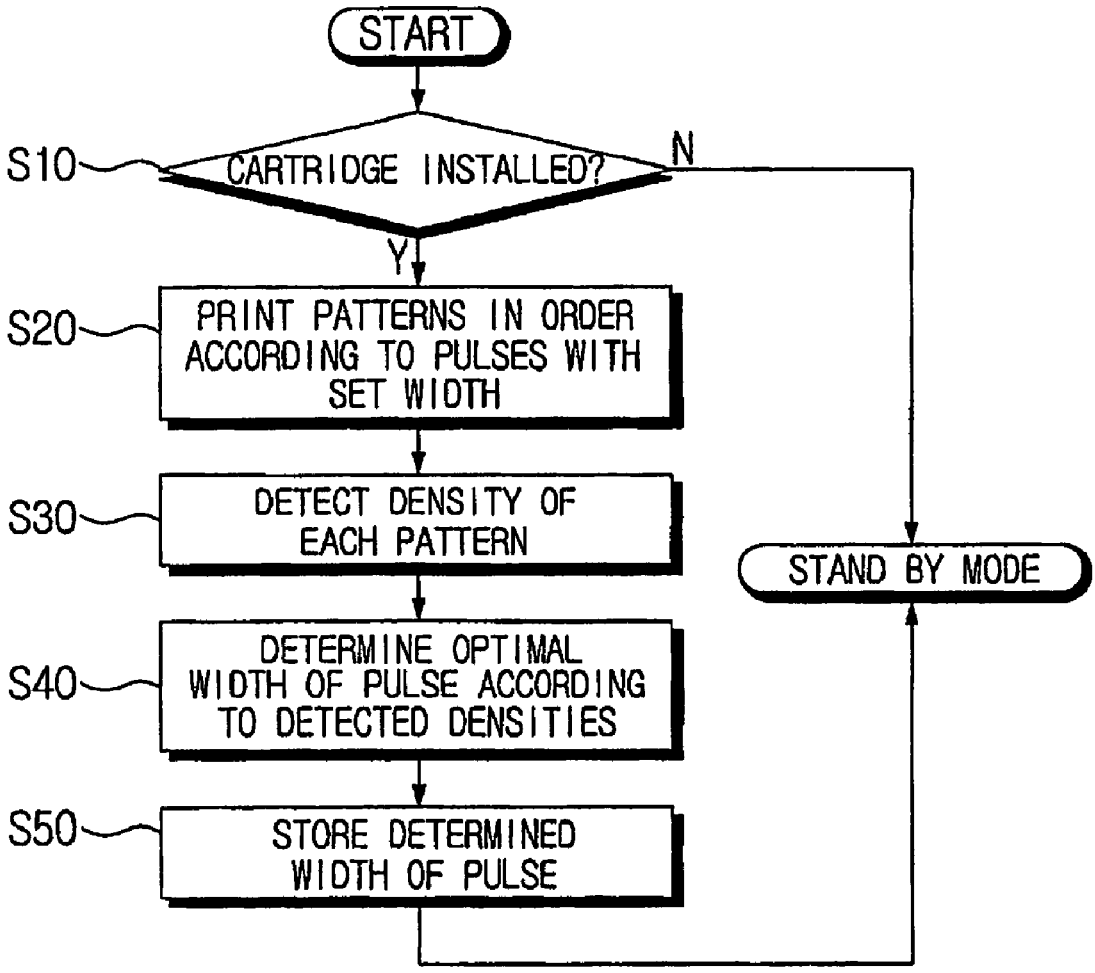
FIG. 3 is a flow chart illustrating the operation of the ink ejection heater of FIG. 2.
Figure 4:
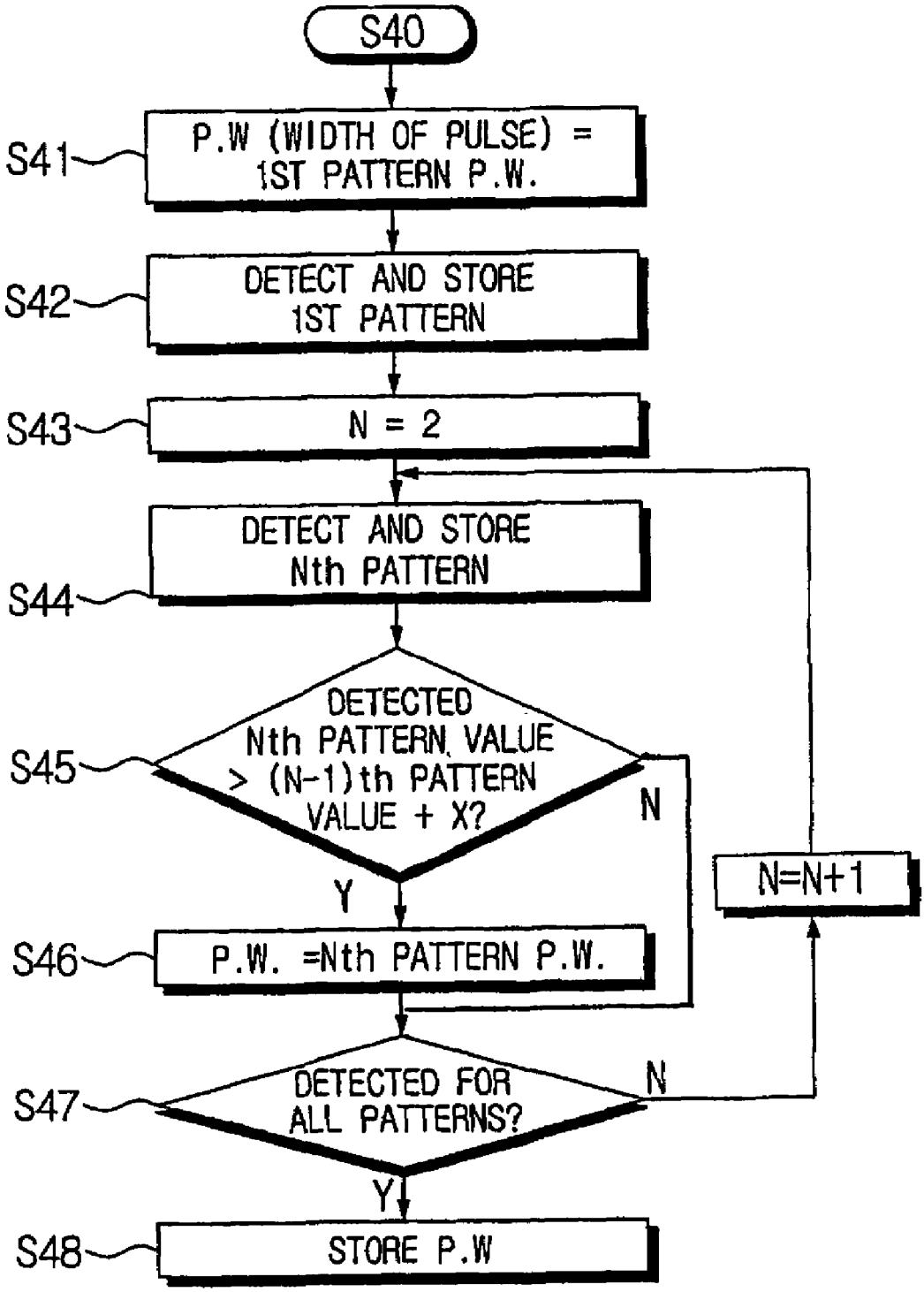
FIG. 4 is a flow chart illustrating a determining operation of FIG. 3 in more detail.

Hereinafter, a control method of using the above controlling device for the inkjet printer will be described with reference to FIGS. 3 to 5. FIGS. 3 and 4 are flow charts illustrating the process of the control method for the inkjet printer, and FIG. 5 is a view showing pulses inputted to the ink ejection heater, printed patterns corresponding to the pulses, and printing densities of the patterns detected by the sensor.

First, it is determined whether the ink cartridge is installed in the inkjet printer with the ink ejection heater (S10). Upon inputting a cartridge install detection signal, it is determined that the ink cartridge is installed so that the control method starts to detect an optimal width of a pulse according to an embodiment of the invention, but the control method maintains a standby status when the cartridge install detection signal is not inputted.

When the cartridge is installed, the ink ejection heater is driven to print patterns in order corresponding to an array of predetermined pulses with widths in sequential order (S20). The array of the pulses with the widths in sequential order has pulses with descending widths, descending by an experimentally set width difference from a reference pulse with an experimentally preset mean width in a predetermined range, and pulses with ascending widths, ascending by the set width difference from the reference pulse with the preset mean width. The input pulses are shown by graphs 202 of FIG. 5. With 'M_PW' representing the mean width of the pulses, and 'a' representing the width difference, it can be seen that the pulses with descending widths M_PW−a, M_PW−2a, and M_PW−3a, multiples of the width difference 'a' being subtracted from the reference pulse with the mean width M_PW, and the pulses with ascending widths M_PW+a, M_PW+2a, and M_PW+3a are inputted. 201 in FIG. 5 shows patterns printed corresponding to the pulses 202, which show a tendency that the more the width of the pulse increases, the more the printing density increases.

Figure 5:
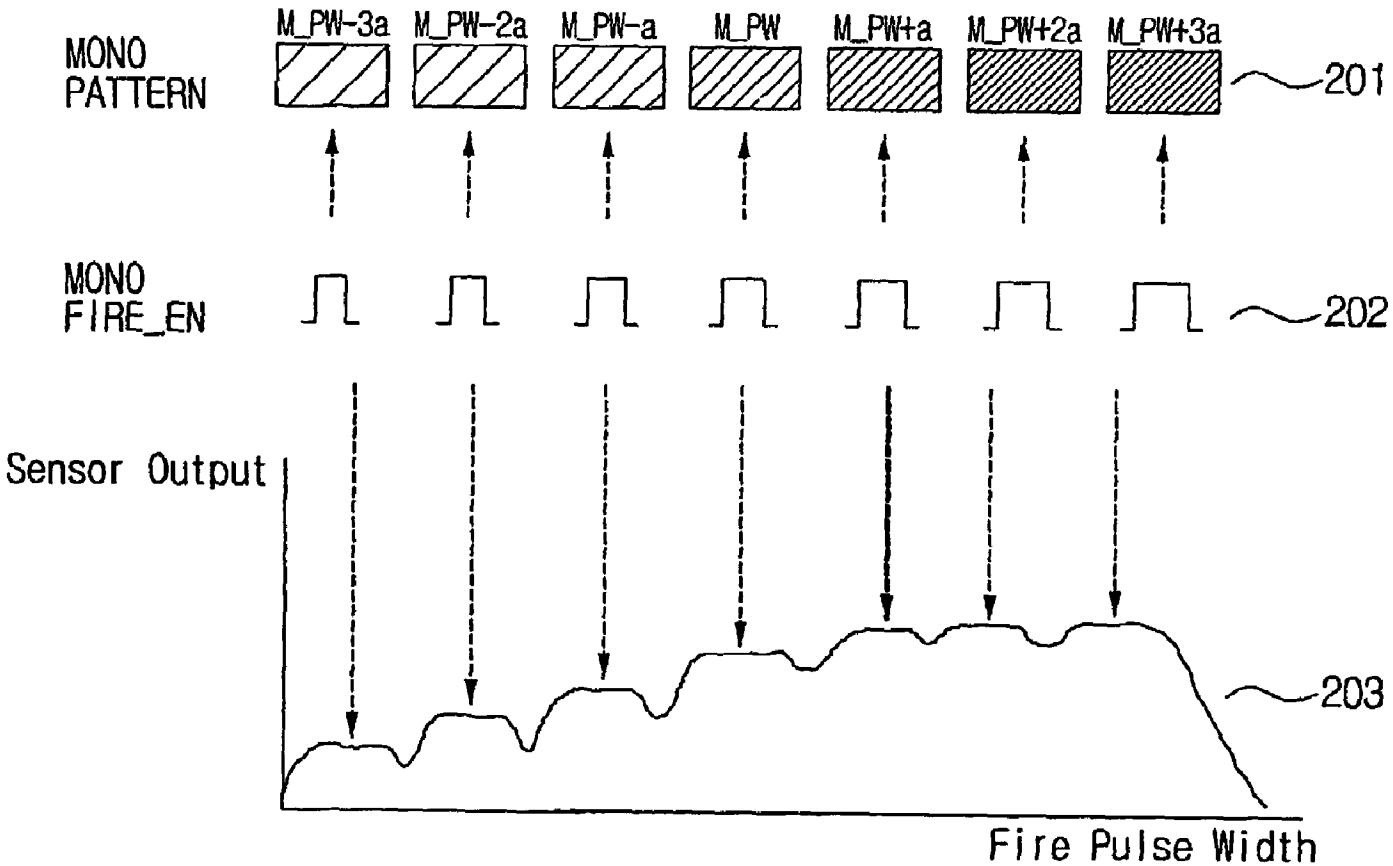
FIG. 5 is a view showing a pulse inputted by the operation in FIG. 3, printed patterns, and detected printing densities.

The sensor 400 detects the printing densities of the printed patterns, and signals corresponding to the detected densities are inputted to the controlling part 100 (S30). 203 in FIG. 5 is a graph showing detected densities outputted from the sensor 400, which shows a tendency that the printing density increases up to M_PW+2a, and the density for M_PW+3a is almost the same as the density for M_PW+2a.

The densities inputted to the controlling part 100 are compared to determine the optimal width of the pulses (S40). FIG. 4 is a flow chart illustrating the operation determining the optimal width of the pulses in more detail, in which the printing density of the pattern corresponding to the smallest width of the pulses is detected and stored (S41, S42), and then the printing density of the pattern corresponding to the next smallest width of the pulses is detected and stored (S43, S44). The printing density $S_{n-1}$ of the (n−1)th pattern and the printing density $S_n$, of the nth pattern are compared (S45). When the density $S_n$ of the nth pattern is larger than the sum of the density $S_{n-1}$ of the (n−1)th pattern plus a predetermined value X, the nth pattern is determined to have the optimal width of the pulses (S46), and S44 through S46 are repeated until all patterns corresponding to the widths of the pulses are detected and compared (S47). When the density $S_n$ of the nth pattern is not larger than the sum of the density $S_{n-1}$ of the (n−1)th pattern plus the predetermined value X, the (n−1)th pattern is determined to have the optimal width of the pulses. In other words, when the density is not increased by a predetermined difference, the optimal width of the pulses is not set to be larger. This is because it may adversely affect the life span of a printer head if a pulse with a larger width than a proper width is applied to the heater.

The optimal width of the pulse determined at S46 is stored in the memory (S48), and the printing operation is performed with reference to the stored width of the pulse. By using the above method to set the reference width of the pulse, an optimal width of a pulse can be determined for each head, and a variation according to the heads can be compensated for as a result.

According to an embodiment of the invention, an optimal width of a pulse inputted to the ink ejection heater can be set according to each head so that ink can be ejected uniformly, thereby improving the printing quality.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of controlling an inkjet printer having an ink ejection heater, the method comprising:

determining whether an ink cartridge is installed in the inkjet printer;

printing patterns in order by driving the ink ejection heater with an array of predetermined pulses with widths that vary in sequential order in response to the ink cartridge being connected to the inkjet printer;

detecting printing densities of the printed patterns;

determining a pattern with an optimal density among the printing densities based on a computed difference between a first printing density, of the printing densities, and a second printing density, of the printing densities, meeting a predetermined condition; and storing a width of a pulse corresponding to the pattern with the optimal density as an optimal pulse width.

2. The method according to claim 1, wherein the widths of the pulses in sequential order comprise pulses with widths descending by a predetermined width difference from a reference pulse, and pulses with widths ascending by the predetermined width difference from the reference pulse.

3. The method according to claim 1, wherein a printing operation is performed with reference to the stored optimal pulse width.

4. The method according to claim 1, wherein a standby status is maintained when a cartridge install detection signal is not inputted.

5. A method of controlling an inkjet printer having an ink ejection heater, the method comprising:

determining whether an ink cartridge is installed in the inkjet printer; printing patterns in order by driving the ink ejection heater with an array of predetermined pulses with widths that vary in sequential order in response to the ink cartridge being connected to the inkjet printer;

detecting printing densities of the printed patterns;

determining a pattern with an optimal density among the printing densities; and storing a width of a pulse corresponding to the pattern with the optimal density as an optimal pulse width, wherein the determining the pattern with the optimal density comprises:

comparing the printing densities of each of the printed patterns, after the first printed pattern, with that of the respective previous printed patterns;

storing the width of the pulse corresponding to the current density in response to the current density being larger, by a predetermined difference, than the previous density; and storing the width of the pulse corresponding to the previous density in response to the current density not being larger, by the predetermined difference, than the previous density.

6. The method according to claim 5, wherein the predetermined difference is evaluated by adding a predetermined value to the previous density, and determining whether the current density is larger than the sum of the previous density and the predetermined value.

7. A method of controlling an inkjet printer having an ink ejection heater, the method comprising:

determining whether an ink cartridge is installed in the inkjet printer;

printing patterns in order by driving the ink ejection heater with an array of predetermined pulses with widths that vary in sequential order in response to the ink cartridge being connected to the inkjet printer;

detecting printing densities of the printed patterns;

determining a pattern with an optimal density among the printing densities; and storing a width of a pulse corresponding to the pattern with the optimal density as an optimal pulse width, wherein the widths of the pulses in sequential order comprise pulses with widths descending by a predetermined width difference from a reference pulse, and pulses with widths ascending by the predetermined width difference from the reference pulse, and wherein the reference pulse has a mean width of the array of predetermined pulses.

8. A controlling device for an inkjet printer having an ink ejection heater, comprising:

a cartridge receiving part installing an ink cartridge therein and outputting an install detection signal;

a driving part driving the ink ejection heater, in accordance with an external input control signal, to eject ink in the ink cartridge while performing a printing operation;

a sensor detecting printing densities of patterns printed on printing media by the printing operation driven by the driving part;

a controlling part controlling the driving part so that pulses with widths that vary in sequential order by a predetermined width difference are applied to the ink ejection heater to print patterns corresponding to the widths of the pulses, and determining a width of a pulse corresponding to a pattern with an optimal density based on a computed difference between a first printing density, of the printing densities, and a second printing density, of the printing densities, meeting a predetermined condition; and a memory storing the width of the pulse corresponding to the pattern with the optimal density determined by the controlling part.

9. The controlling device according to claim 8, wherein the widths of the pulses in sequential order comprise pulses with widths descending by the predetermined width difference from a reference pulse, and pulses with widths ascending by the predetermined width difference from the reference pulse.

10. The controlling device according to claim 8, wherein the controlling part controls the driving part to perform the printing operation according to the width of the pulse stored in the memory upon inputting a printing command.

11. The controlling device according to claim 8, wherein the sensor is disposed under the ink cartridge.

12. A controlling device for an inkjet printer having an ink ejection heater, comprising:

a cartridge receiving part installing an ink cartridge therein and outputting an install detection signal;

a driving part driving the ink ejection heater, in accordance with an external input control signal, to eject ink in the ink cartridge while performing a printing operation;

a sensor detecting printing densities of patterns printed on printing media by the printing operation driven by the driving part;

a controlling part controlling the driving part so that pulses with widths that vary in sequential order by a predetermined width difference are applied to the ink ejection heater to print patterns corresponding to the widths of the pulses, and determining a width of a pulse corresponding to a pattern with an optimal density by comparing the printing densities outputted from the sensor; and a memory storing the width of the pulse corresponding to the pattern with the optimal density determined by the controlling part, wherein the controlling part compares the densities of the patterns in ascending order to determine, as an optimal pulse width, the width of the pulse corresponding to the pattern which has the highest density that is larger, by a predetermined difference, than the density of the previous pattern.

13. A printer having an ink ejection heater, comprising:

a cartridge receiving part to receive an ink cartridge therein and outputting an install detection signal; and a controlling part that determines an optimal width of a pulse inputted to the ink ejection heater in response to receiving the install detection signal;

wherein the optimal width of the pulse is set according to each head, so that ink is ejected uniformly, based on a computed difference between a first printing density, generated from a first pulse width, and a second printing density, generated from a second pulse width, meeting a predetermined condition.

14. The printer according to claim 13, further comprising a memory, wherein the optimal width of the pulse is stored in the memory, and a printing operation is performed with reference to the stored optimal width of the pulse.

15. A system comprising:

a printer having an ink ejection heater;

a cartridge receiving part receiving an ink cartridge;

a sensor detecting printing densities of patterns printed on printing media; and a controller part controlling widths of pulses sent to the ink ejection heater;

wherein the controller causes the printer to print a series of printing patterns with pulses of varying widths, and determines an optimal pulse width for the ink cartridge by evaluating the printing densities of the printed patterns based on a computed difference between a first printing density, of the printing densities, and a second printing density, of the printing densities, meeting a predetermined condition.

16. The system of claim 15, further comprising a memory, wherein the optimal pulse width is stored in the memory, and a printing operation is performed with reference to the stored optimal pulse width.

* * * * *